US005988118A

United States Patent [19]

Park

[11] Patent Number: 5,988,118

[45] Date of Patent: Nov. 23, 1999

[54] WATER SUPPLYING METHOD FOR A BOILER

[75] Inventor: Jae-Gyeong Park, Incheon, Rep. of Korea

[73] Assignee: Daewoo Electronics Co., Ltd., Seoul, Rep. of Korea

[21] Appl. No.: 08/960,341

[22] Filed: Oct. 29, 1997

[30] Foreign Application Priority Data

Oct. 29, 1997 [KR] Rep. of Korea ..... 96-49764

[51] Int. Cl.[6] ..... F22D 7/00

[52] U.S. Cl. ..... 122/406.1; 122/332

[58] Field of Search ..... 122/1 C, 5, 17, 122/6 R, 44.1, 114, 332, 406.1, 379, 380, 392

[56] References Cited

U.S. PATENT DOCUMENTS 3,399,655 9/1968 Arant ..... 122/406.1
4,090,474 5/1978 Kauffmann ..... 122/20 B
4,298,165 11/1981 McKinley .
5,596,953 1/1997 Hong .
5,709,173 1/1998 Ahtila et al. ..... 122/1 C

*Primary Examiner*—Teresa Walberg
*Assistant Examiner*—Gregory A. Wilson
*Attorney, Agent, or Firm*—Smith, Gambrell & Russell, LLP; Beveridge, DeGrandi, Weilacher & Young Intellectual Property Group

[57] ABSTRACT

A method for supplementing fresh water into a boiler, which can effectively exhaust air from a pipeline circuit connected with the boiler, is disclosed. The method includes the steps of: a) determining whether a supply of the supplementary water into the boiler is completed; b) operating a circulation pump with a first operation manner for a first predetermined period when the supplementation of the fresh water is completed; and c) operating the circulation pump with a second operation manner for a second predetermined period after the first predetermined period passes. Therefore, the air, which has flowed into the pipeline circuit when the supplementary water was supplemented into the boiler, is effectively exhausted.

20 Claims, 6 Drawing Sheets

WATER SUPPLYING METHOD FOR A BOILER

BACKGROUND OF THE INVENTION

1. Field of the Invention

This invention is related to a method for controlling a boiler, more particularly to a method for supplying fresh water into a pipeline circuit of a boiler.

2. Description of the Prior Art

Generally, when a boiler is installed, it is important that a pipeline circuit of the boiler must be filled with heating water without flowing of air into the pipeline circuit. However, it is very difficult to prevent air from flowing into the pipeline circuit of the boiler, because filling the pipeline circuit of the boiler with the heating water is dependent on know-how of a skilled worker because the inside of the pipeline circuit is directly not shown. While the boiler is driven when air is in the pipeline circuit, a circulation pump of the boiler is damaged by inflow of the bubbles. Therefore, the boilers have an air exhausting means, such as an air vent, in order to exhaust the air through it.

The air flowing into the pipeline forms large bubbles in several portions of the pipeline circuit. Also, these large bubbles are divided into small bubbles when the heating water flows in the pipeline, such that the air vent cannot exhaust the air inflowed into the pipeline.

One example of a control for a boiler is disclosed in U.S. Pat. No. 4,298,165. The control for a boiler suggested in U.S. Pat. No. 4,298,165 controls a furnace and a circulation pump thereof with a timer and a thermostat.

However, the control for a boiler had not suggested a method that can exhaust air which is inputted into a pipeline circuit of a boiler during supplementation of heating water into the pipeline circuit.

SUMMARY OF THE INVENTION

It is an object of the present invention to provide a water supplying method for a boiler which can effectively exhaust air which flows into a pipeline circuit with supplementary water.

In order to achieve the above object, a water supplement method for a boiler according to the present invention includes the steps of a) determining whether a supply of the supplementary water into the pipeline circuit of the boiler is completed; b) operating the circulation pump with a first operation manner for a first predetermined period when the supply of the supplementary water is completed; and c) operating the circulation pump with a second operation manner for a second predetermined period after the first predetermined period.

According to the present invention, the water supplying method effectively exhausts air from the pipeline circuit of the boiler, which flows into the pipeline circuit with supplementary water, thereby improving a thermal efficiency of the boiler and preventing the boiler from being overheated.

BRIEF DESCRIPTION OF THE DRAWINGS

The foregoing and other objects, aspects and advantages will be better understood from the following detailed description of preferred embodiments of the invention with reference to the drawings, in which.

DESCRIPTION OF THE PREFERRED EMBODIMENT

Preferred embodiments of the present invention will be illustrated below with reference to the accompanying drawings.

Figure 1:
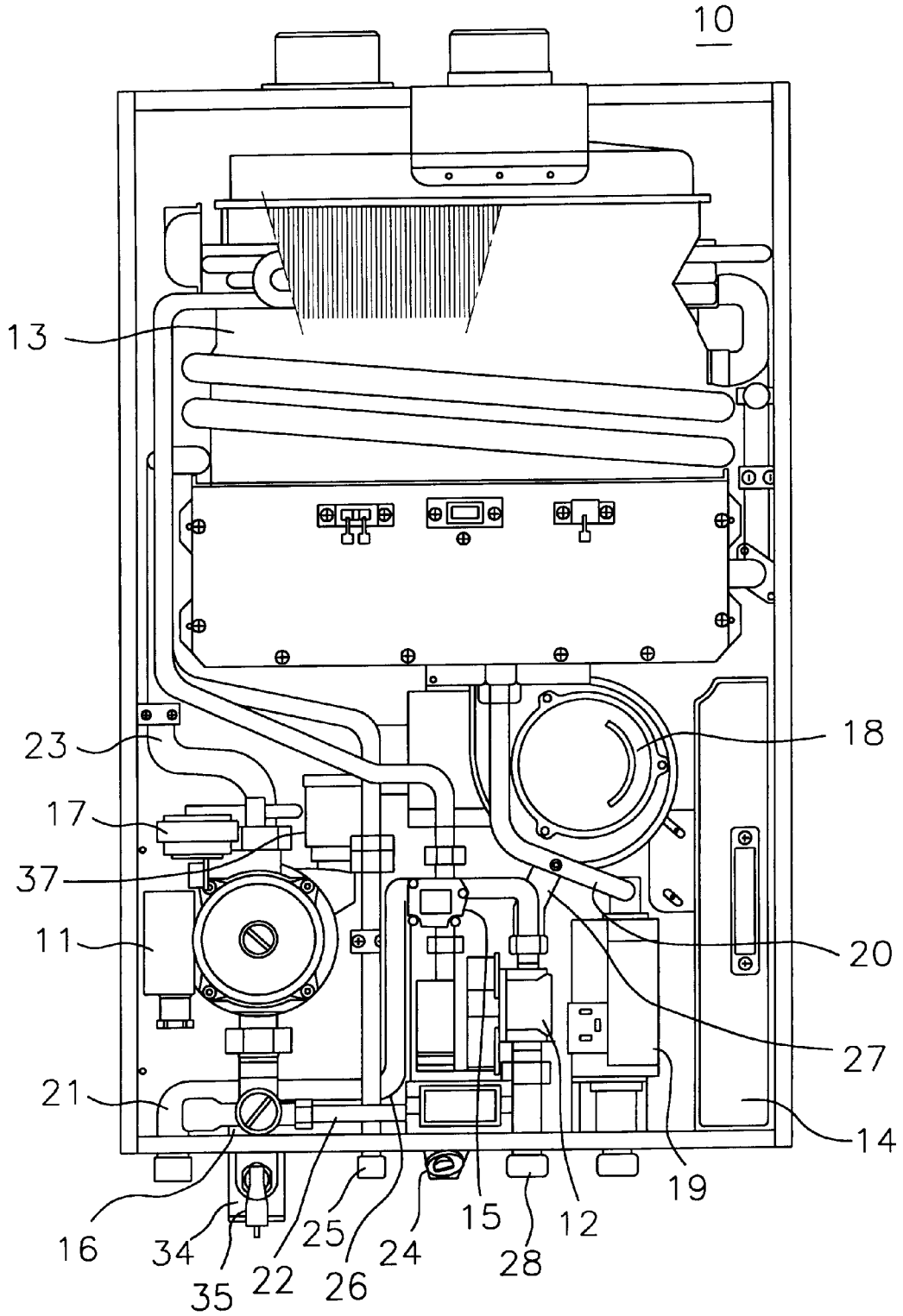
FIG. 1 is a view for showing the internal structure of a conventional gas boiler.

FIG. 1 is a view for showing the internal structure of a conventional boiler.

Figure 5:
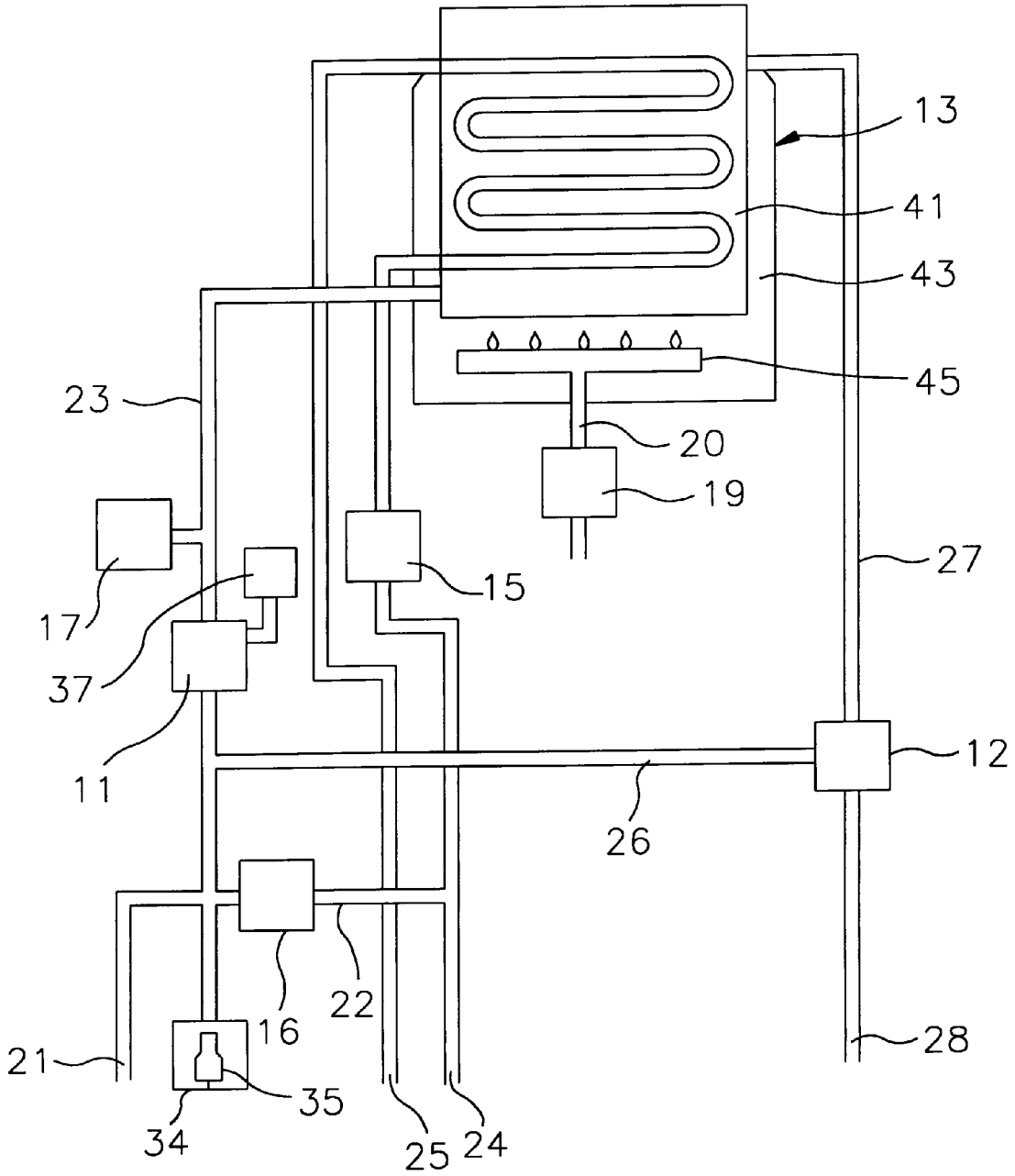
FIG. 5 is a view for showing the connection of pipelines with one another depicted in FIG. 1.

FIG. 5 is a view for showing the connection of pipelines with one another depicted in FIG. 1.

Referring to FIGS. 1 and 5, a boiler 10 generally includes an accumulator (not shown), a circulation pump 11, a three-way valve 12, a heat exchanger 13, and a controller 14.

The boiler 10 additionally includes a flow sensor 15, a supplementary water valve 16, safety switch 17, a fan 18, a gas valve 19, a plurality of pipelines, and a plurality of electric wires (not shown).

The accumulator accumulates an increased or reduced internal pressure which is generated by a volume variation for a temperature variation of heating water.

The circulation pump 11 is connected with a heating water return pipe 21 through which the heating water returns from a heating place. The heating water return pipe 21 is connected with a supplementary water supply pipe 22. The circulation pump 11 is driven by a motor (not shown) to raise the pressure of the heating water and circulates the heating water.

A first heating water supply pipe 23 extends from an outlet of the circulation pump 11 to an inlet of the heat exchanger 13 to supply the heating water from the circulation pump 11 to a heating water tank 41 of the heat exchanger 13. The circulation pump 11 has a low portion which is connected with a pump drain pipe 34 on which a drain cock 35 is mounted at a middle portion of the pump drain pipe 34.

The heat exchanger 13 has the heating water tank 41 formed at the inside thereof. A combustion chamber 43 is formed between the heat exchanger 13 and a burner 45. The burner 45 is connected with a gas supply pipe 20. The gas supply pipe 20 provides gaseous fuel, such as LNG or LPG, from an external gas source (not shown) to the burner.

As shown in FIG. 1, a gas valve 19 is disposed in the middle of the gas supply pipe 20. The gas supply valve 19 adjusts the quantity of the gas to be supplied to the burner according to a control signal provided from the controller 14.

The fan 18 is installed below the heat exchanger 13. The fan 18 provides air into the combustion chamber to assist the combustion of the gas and to prevent a gas explosion within the combustion chamber.

The supplementary water supply pipe 22 connects the heating water return pipe 21 with a fresh water supply pipe 24. A supplementary water valve 16 is installed in the middle of the supplementary water supply pipe 22. The supplementary water valve supplies supplementary water, which is provided through the fresh water supply pipe 24, to the heating water return pipe 21 according to a control signal which is provided from the controller 14. The supplementary water valve is opened or shut according to the control signal from the controller, thereby controlling the providing of the supplementary water into the pipeline circuit of the boiler 10. The fresh water supply pipe 24 is connected with an external water source (not shown) in order to provide the fresh water from the external water source into the heating water tank of the heat exchanger 13. A hot water supply pipe 25 extends from the fresh water supply pipe 24 through the heating water tank of the heat exchanger 13, such that the fresh water is changed into high temperature hot water by indirectly receiving the heat from the heating water heated by the burner within the heat exchanger 13.

A flow sensor 15 is installed at the middle of the fresh water supply pipe 24 to sense the quantity of water flowing through there. The flow sensor 15 generates a flow sensing signal corresponding to the quantity of water and provides the flow sensing signal to the controller 14.

The three way valve 12 is connected with an internal circulation pipe 26, a second heating water supply pipe 27, and a heating water discharge pipe 28. The three way valve 12 outputs the heating water, which is from the heat exchanger 13 and through the second heating water supply pipe 27, into either the internal circulation pipe 26 or the heating water discharge pipe 28 according to a control signal from the controller 14. The internal circulation pipe 26 provides the heating water to the circulation pump 11 when the heating water flows into the internal circulation pipe 26. The heating water discharge pipe 28 discharges the heating water into the heating place.

The boiler 10 is provided with an air exhausting means, such as an air vent 37. The air vent 37 exhausts bubbles which are formed by air introduced in the pipeline circuit of the boiler 10. The air vent 37 can be installed at any portion of the pipeline circuit of the boiler 10, but preferably, at the circulation pump 11, as shown in FIG. 1.

The controller 14 is a PCB box 14 which is placed at the right of the gas valve 19. The controller 14 controls overall operations of the gas boiler 10 according to a control program and several sensing signals.

The safety switch 17 is a pressure switch 17 or flow switch (not shown). If the safety switch 17 is the pressure switch 17, the pressure switch 17 is installed parallel with the first heating water supply pipe 23. The pressure switch 17 is turned on when internal pressure of the pipeline circuit of the gas boiler 10 is lower than that of a reference pressure. Also if the safety switch 17 is the flow switch, the flow switch is installed in series with the pipeline circuit of the gas boiler 10. The flow switch is turned on when the flow rate of the heating water is less than a reference flow rate.

First, when the gas boiler 10 is in a heating mode, the controller 14 controls the gas valve 19 and the fan 18 to supply fuel gas and air to the burner, and drives an ignition generator (not shown) to ignite the burner. As the burner is driven, the heating water in the heat exchanger 13 is heated, such that the temperature of the heating water rises.

When the temperature of the heating water is higher than a reference temperature which is predetermined according to a method of manufacturing of the gas boiler, the controller drives the circulation pump to make the high temperature heating water discharge from the heat exchanger 13 to the three way valve 12. At the same time, the controller controls the three way valve 12 to shut off the internal circulation pipe 26 and open the heating water discharge pipe 28, such that the heating water, which flows through the second heating water supply pipe 27 into the three way valve 12, is provided to the heating place through the heating water discharge pipe 28.

The heating water which returns to the gas boiler 10 since the temperature thereof is lowered after executing room heating, is introduced into the circulation pump 11 through the heating water return pipe 21. The heating water which returns to the gas boiler 10 flows into the heat exchanger 13 through the first heating water supply pipe 23 by a pumping force of the circulation pump 11.

On the other hand, unlike the circulation of the heating water, the fresh water is supplied to the heating water tank of the heat exchanger 13 via the water supply pipe 24 which is coil-shaped within the heat exchanger 13. At this time, the fresh water is changed into the high temperature hot water of high temperature by indirectly receiving the heat from the heating water within the heat exchanger 13. The hot water prepared as above is guided to the user via the hot water supply pipe 25.

When the operation mode of the gas boiler 10 is in the hot water mode, the controller 14 controls the three way valve 12 to shut off the inlet of the heating water discharge pipe 28 and open the inlet of the internal circulation pipe 26, such that the heating water, which has flowed into the three way valve 12 from the second heating water supply pipe 27 via the heat exchanger 13, flows into the circulation pump 11 via the internal circulation pipe 26. That is, the heating water, which is heated within heat exchanger 13, returns again to the heat exchanger 13. Also, as the fresh water flowing through the fresh water supply pipe 24 flows into the heat exchanger 13, the fresh water is indirectly heated by the high temperature heating water within the heat exchanger 13.

As the gas boiler 10 operates, the quantity of the heating water within the pipeline circuit of the boiler 10 may be reduced because the heating water naturally evaporates as the heating water is heated and cooled, or the heating water leaks from the pipeline circuit.

When the quantity of the heating water is lacking in the pipeline circuit of the gas boiler 10, the safety switch 17 senses the lack of the heating water within the pipeline circuit of the gas boiler 10 and is turned on to generate a signal indicating heating water is lacking. Then, the controller 14 controls the gas valve 19 to prevent gas from being supplied to the burner, and the supplementary water valve 16 to make the supplementary water to be supplied to the pipeline circuit of the gas boiler 10 via the supplementary water pipe 22.

The operation of supplying the supplementary water to the pipeline circuit of the gas boiler 10 is illustrated below in detail with reference to the accompanying drawings, FIGS. 2 through 4.

First Embodiment

Figure 2:
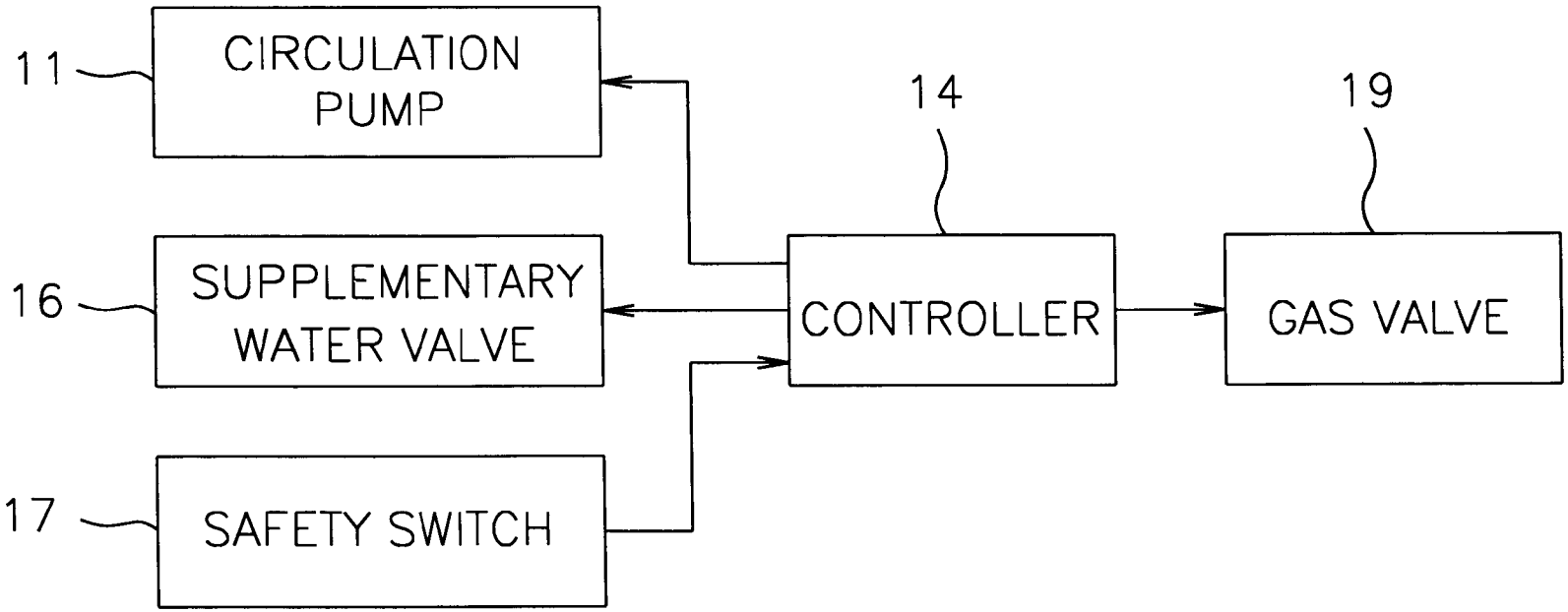
FIG. 2 is a block diagram for illustrating the operation of the controller of the gas boiler depicted in FIG. 1.

FIG. 2 is a block diagram for illustrating the operation of the controller 14 when the supplementary water is supplied.

Referring to FIG. 2, when the safety switch 17 senses the lack of heating water, the controller 14 controls the supplementary water valve 16, the circulation pump 11, and the gas valve 19 to supply supplementary water to the pipeline circuit of the gas boiler 10.

Figure 3:
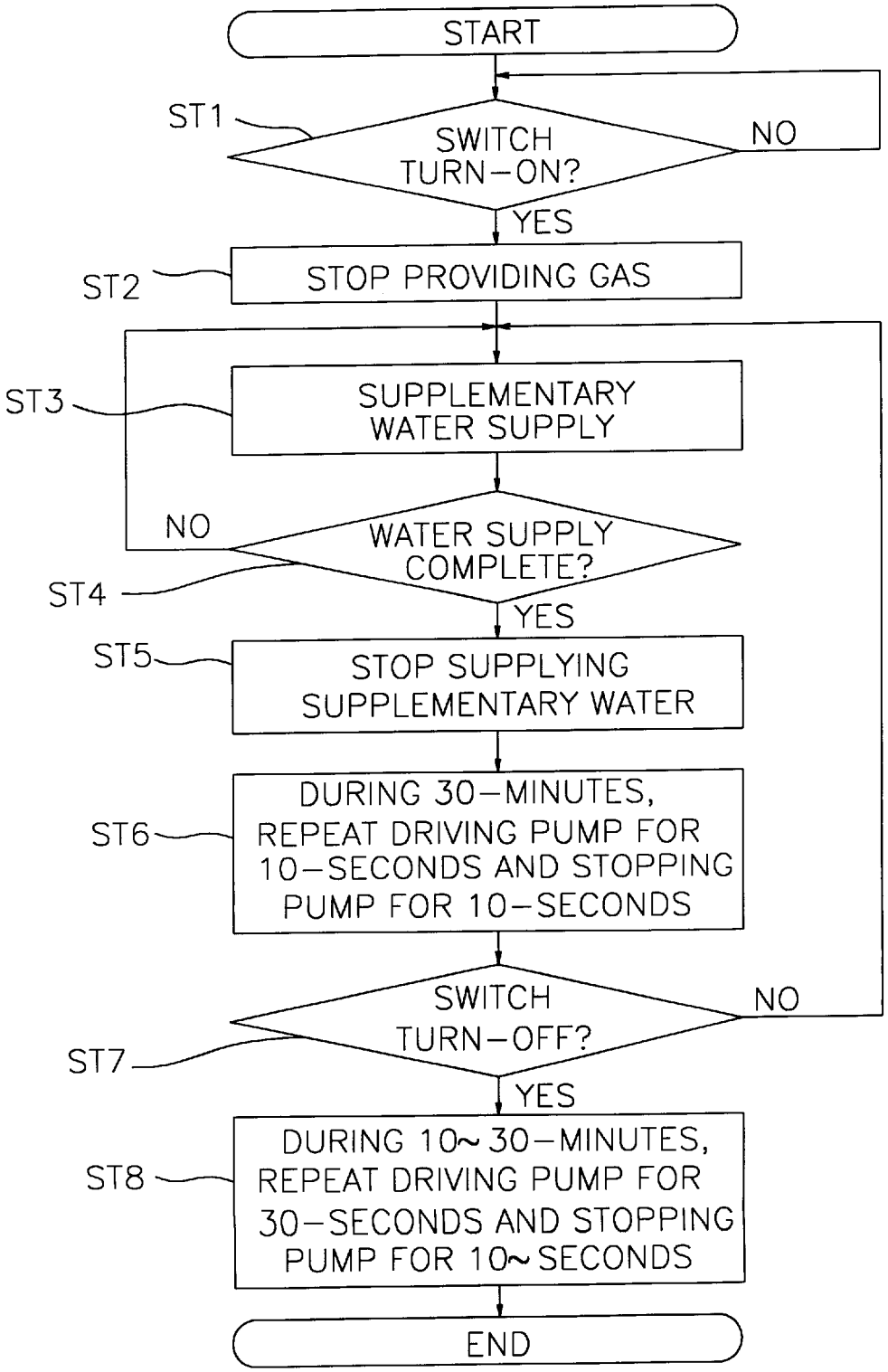
FIG. 3 is a flow chart for illustrating a method according to the first embodiment of the present invention.

FIG. 3 is a flow chart for illustrating the method for supplying supplementary water to the pipeline circuit according to the first embodiment of the present invention when a pressure switch is used as the safety switch 17.

Referring to FIG. 3, when the pressure of the heating water of the pipeline is lower than a reference pressure, the pressure switch 17 is turned on, thereby generating a turn-on signal. Also, the turn-on signal generated from the pressure switch 17 is provided to the controller 14 as a signal for informing the controller 14 of the lack of the heating water (ST1).

When the turn-on signal is inputted from the pressure switch 17 to the controller 14, the controller 14 controls the gas valve 19 to cut off the supplying of the gas to the burner, such that overheating of the gas boiler 10 is prevented (ST2).

At the same time, the controller 14 drives the supplementary water valve 16 to supply the supplementary water to the heating water return pipe 21 through the supplementary water pipe 22 (ST3).

As the supplementary water flows into the pipeline of the gas boiler 10 through the supplementary water valve 16, the pressure of the heating water in the pipeline is increased. When the pressure of the heating water is higher than that of the reference pressure, the pressure switch 17 is turned off, such that the pressure switch 17 generates a turn-off signal as a signal for indicating that the supplying of the supplementary water is completed and provides the turn-off signal to the controller 14 (ST4).

When the turn-off signal is inputted to the controller 14, the controller 14 controls the supplementary water valve 16 to stop supplying the supplement water into the pipeline circuit of the boiler 10 (ST5).

And then, the controller 14 causes the circulation pump 11 to driven with a first driving manner during a first predetermined time period. For instance, the first driving manner makes it repeat, during the first predetermined time period, to drive the circulation pump 11 for a second predetermined time period and stop driving the circulation pump 11 for a third predetermined time period. The repeat of driving and stopping of the circulation pump according to the first driving manner makes it possible to combine small bubbles with each other, thereby forming large bubbles enough to be exhausted through the air vent 37. Preferably, the first predetermined time period is thirty minutes, and the second and third predetermined time periods are thirty seconds, respectively (ST5, ST6).

After the first predetermined time period, in step 7, the controller 14 determines whether the pressure switch 14 is turned on or not. The pressure switch 14 is turned on if the air in the pipeline of the gas boiler is extensively exhausted to reduce the internal pressure of the pipeline circuit of the gas boiler 10. When the turn-on signal is inputted from the pressure switch 14, the controller 14 returns to step 3. On the contrary, when the pressure switch 14 remains turn-off, the controller 14 performs the next step (ST7).

In step 8, the controller 14 causes the circulation pump 11 to be driven with a second driving manner during a fourth predetermined time period. For instance, the second driving manner makes it repeat, during the fourth predetermined time period, to drive the circulation pump 11 for a fifth predetermined time period and stop driving the circulation pump 11 for a sixth predetermined time period. The driving and stopping of the circulation pump 11 according to the second driving manner makes it possible to combine small bubbles with each other, thereby forming large enough bubbles as to be exhausted through the air vent. Preferably, the fourth predetermined time period is 10~30 minutes, the fifth predetermined time period is for 30 seconds, and the sixth predetermined time period is for 10 seconds, respectively (ST8).

Therefore, according to the first embodiment of the present invention, the water supplying method effectively exhausts air in the pipeline circuit of the boiler which flows into the pipeline circuit with supplementary water, thereby improving thermal efficiency of the boiler and preventing the boiler from being overheated.

Second Embodiment

Figure 4A:
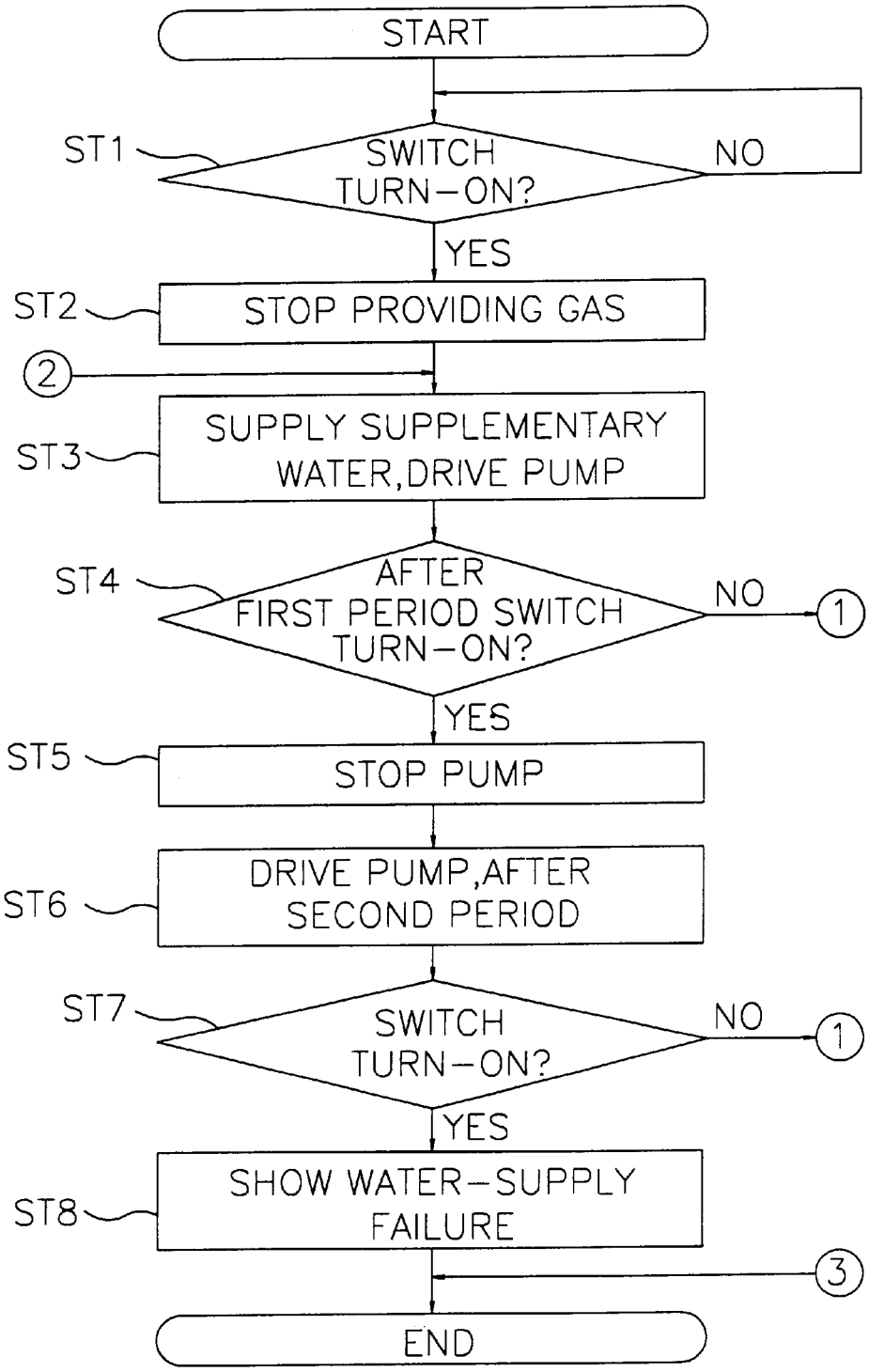
FIGS. 4A and 4B are flow charts for illustrating a method according to the second embodiment of the present invention.
Figure 4B:
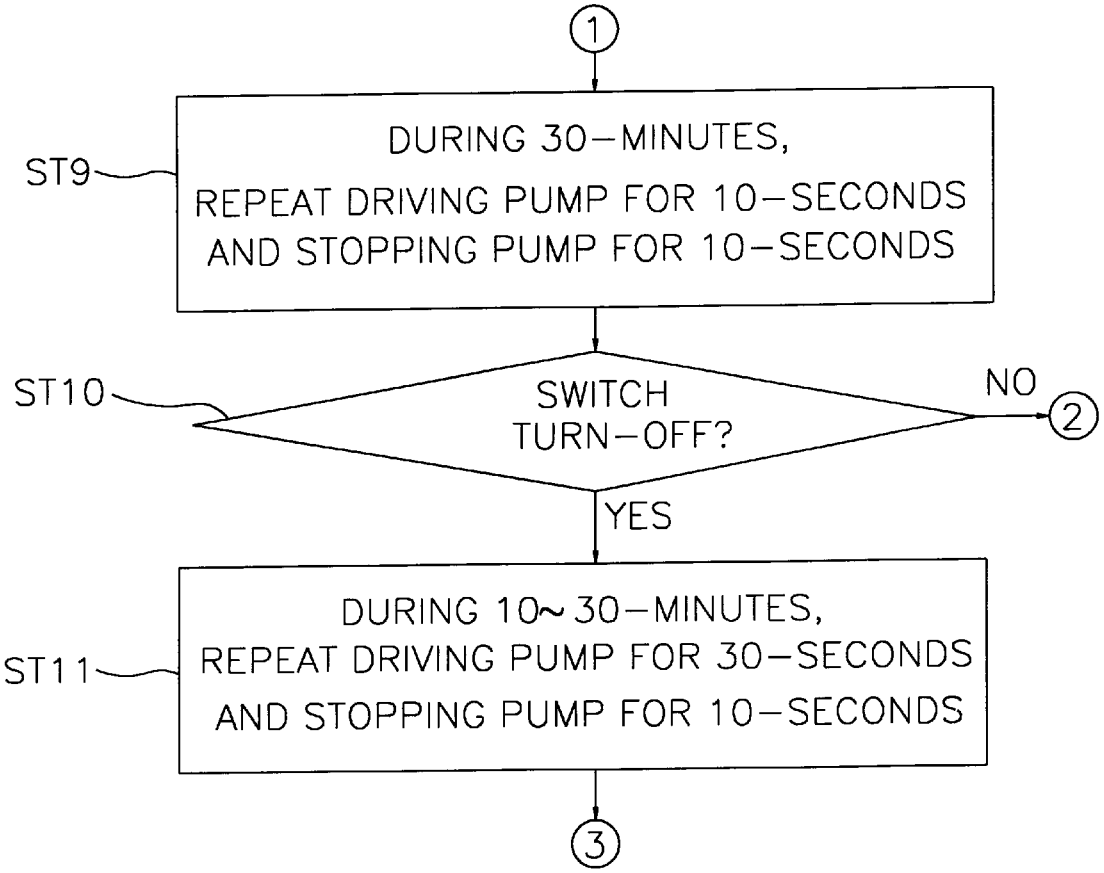

FIGS. 4*a* and 4*b* are flowcharts for illustrating the method for supplying supplementary water to the pipeline circuit of the gas boiler 10 according to the second embodiment of the present invention.

When a flow switch is used as the safety switch 17 for sensing the quantity of the heating water flowing in the pipeline circuit of the gas boiler 10, the flow switch is turned on or off according to whether the flow quantity of the heating water flowing through the flow switch is less than that of a reference flow or not.

Referring to FIGS. 4*a* and 4*b*, in step 1, the controller 14 determines whether the flow switch is turned on or off. And, when the flow switch is turned on, the controller 14 controls the gas valve 19 to cut off the supplying of gas into the burner (ST1, ST2).

And then, the controller 14 controls the supplementary water valve 19 to open the outlet of the supplementary water valve 16 in order to supply the supplementary water to the heating water return pipe 21 through the supplementary water valve 16, such that the quantity of heating water in the pipeline circuit of the gas boiler 10 is compensated as much as any shortage. At the same time, the circulation pump 11 is driven by the controller 14 (ST3).

After a first predetermined time period has passed since the circulation pump 11 is drived by the step 3, the controller 14 checks whether the flow switch is turned on or not (ST4).

If the flow switch is turned off, the controller 14 performs step 9 which will be illustrated below. On the contrary, if the flow switch consistently remains turned on, the controller 14 causes the circulation pump 11 to stop pumping the heating water (ST5).

After a second predetermined time period since the circulation pump 11 is stopped, the controller 14 drives the circulation pump 11 again (ST6).

By step 7, the controller 14 checks whether the flow switch is turned on or not. When the supplementary water supply is suspended, the quantity of heating water is not increased, so the flow switch remains turned on. Therefore, if the flow switch is turned on in step 7, the controller 14 determines that the water supply is suspended and controls an electric panel to make known the suspension of the water supply (ST7, ST8).

On the contrary, in step 7, if the flow switch is turned off, the controller 14 causes the circulation pump 11 to be driven with a first driving manner during a third predetermined time period. For instance, the first driving manner makes it repeat during the first predetermined time period to drive the circulation pump 11 for a fourth predetermined time period and stop driving the circulation pump 11 for a fifth predetermined time period. The driving and stopping of the circulation pump 11 according to the first driving manner makes it possible to combine small bubbles with each other, thereby forming large enough bubbles as to be exhausted through the air vent. Preferably, the third predetermined time period is for thirty minutes, and the fourth and fifth predetermined time periods are for thirty seconds, respectively (ST9).

After the third predetermined time period, thirty-minutes, the controller 14 performs a step 10. In step 10, the controller 14 checks the state of the flow switch. As the air in the pipeline is exhausted by the steps, the quantity of the heating water flowing through the flow switch decreased, such that the flow switch is turned on. And then, the controller 14 returns to step 3. When the flow switch remains turned off, the controller 14 goes to the next step 11 (ST10).

In step 11, the controller 14 causes the circulation pump 11 to be driven with a second driving manner during a sixth predetermined time period. For instance, the second driving manner makes it repeat, during the sixth predetermined time period, to drive the circulation pump 11 for a seventh predetermined time period and stop driving of the circulation pump 11 for an eighth predetermined time period. The driving and stopping of the circulation pump 11 according to the second driving manner makes it possible to combine small bubbles with each other, thereby forming large enough bubbles as to be exhausted through the air vent. Preferably, the sixth predetermined time period is for 10~30 minutes, the seventh predetermined time period is for 30 seconds, and the eighth predetermined time period is for 10 seconds, respectively (ST11).

Therefore, according to the second embodiment of the present invention, the water supplying method effectively exhausts air in the pipeline circuit of the boiler which flows into the pipeline circuit with supplementary water, thereby improving thermal efficiency of the boiler and preventing the boiler from being overheated.

While the invention has been described in terms of preferred two embodiments, those skilled in the art will recognize that the invention can be practiced with modification within the spirit and scope of the appended claims.

What is claimed is:

1. A method for exhausting air from a pipeline circuit of a boiler when supplementary water is supplied into the boiler, the method comprising the steps of:

a) determining whether a supply of the supplementary water into the pipeline circuit of the boiler is performed;

b) circulating a heating water through a pipeline circuit of the boiler with a first operation manner for a first predetermined period when the supply of the supplementary water is performed, thereby combining small bubbles in the pipeline circuit with one another in order to form large bubbles to be exhausted by an air exhausting means, wherein the air exhausting means is installed at a portion of the pipeline circuit; and c) circulating the heating water through the pipeline circuit with a second operation manner for a second predetermined period after the first predetermined period, thereby combining small bubbles which remain in the pipeline circuit after step b) with one another in order to form large bubbles to be exhausted by the air exhausting means.

2. A method as recited in claim 1, wherein said first operation manner makes it repeat to circulate the heating water for a third predetermined period and stop the circulation of the heating water for a fourth predetermined period.

3. A method as recited in claim 2, wherein said third predetermined period is equal to the fourth predetermined period.

4. A method as recited in claim 3, wherein said third predetermined period is for ten seconds.

5. A method as recited in claim 1, wherein said first predetermined period is for thirty minutes.

6. A method as recited in claim 1, wherein said second operation manner makes it repeat to drive the circulation pump for a fifth predetermined period and stop for a sixth predetermined period.

7. A method as recited in claim 6, wherein said fifth predetermined period is for thirty-seconds and said sixth predetermined period is for ten-seconds.

8. A method as recited in claim 1, wherein said second predetermined period is for a time between from ten-minutes to thirty minutes.

9. A method for controlling a boiler when supplementary water is supplied into the boiler, the boiler including an air exhausting means for exhausting air from a pipeline circuit of the boiler, a supplementary water valve for supplying the supplementary water into a pipeline circuit of the boiler, a pressure switch for sensing a pressure of heating water in the pipeline circuit, a circulation pump for circulating water in the pipeline circuit, and a controller for controlling the supplementary water valve and the circulation pump in response to a turn-on signal and a turn-off signal, wherein the turn-on signal is generated from the pressure switch when the pressure of heating water is lower than a reference pressure, and the turn-off signal is generated from the pressure switch when the pressure of heating water is equal to or higher than the reference pressure, the method comprising the steps of:

a) controlling the supplementary water valve to supply the supplementary water into the pipeline circuit when the turn-on signal is generated from the pressure switch;

b) determining whether a supply of the supplementary water into the boiler is completed or not based on whether the turn-off signal is generated from the pressure switch or not after step a);

c) driving the circulation pump with a first operation manner for a first predetermined period when the supply of the supplementary water is completed, wherein the first operation manner makes it repeat to drive the circulation pump for a second period and stop for a third period, such that small bubbles in the pipeline circuit are combined with one another to form large bubbles to be exhausted by an air exhausting means, wherein the air exhausting means is installed at a portion of the pipeline circuit; and d) driving the circulation pump with a second operation manner for a fourth predetermined period after the first predetermined period, wherein the second operation manner makes it repeat to drive the circulation pump for a fifth period and stop for a sixth period, such that small bubbles which remain in the pipeline circuit after step b) are combined with one another to form large bubbles to be exhausted by the air exhausting means.

10. A method as recited in claim 9, wherein said second predetermined period is equal to the third predetermined period.

11. A method as recited in claim 10, wherein said third predetermined period is for ten-seconds.

12. A method as recited in claim 9, wherein said first predetermined period is for thirty minutes.

13. A method as recited in claim 9, wherein said fifth predetermined period is for thirty-seconds and said sixth predetermined period is for ten-seconds.

14. A method as recited in claim 9, wherein said fourth predetermined period is for a time between from ten minutes to thirty minutes.

15. A method for controlling a boiler when supplementary water is supplied into the boiler, the boiler including an air exhausting means for exhausting air from a pipeline circuit of the boiler, a supplementary water valve for supplying the supplementary water into a pipeline circuit of the boiler, a flow switch for sensing a quantity of heating water flowing through the pipeline circuit of the boiler, a circulation pump for circulating water in the pipeline circuit, and a controller for controlling the supplementary water valve and the circulation pump in response to a switch signal which is generated from the flow switch, the method comprising the steps of:

a) determining whether the quantity of heating water is lacking based on the switch signal;

b) driving the circulation pump in order to circulate the heating water and opening the supplementary water valve in order to supply the supplementary water into the pipeline circuit when the quantity of heating water is lacking;

c) determining whether the supply of the supplementary water is completed;

d) operating the circulation pump with a first operation manner for a first predetermined period when the supply of the supplementary water is completed, such that small bubbles in the pipeline circuit are combined with one another to form large bubbles to be exhausted by an air exhausting means, wherein the air exhausting means is installed at a portion of the pipeline circuit;

e) determining whether the quantity of heating water is lacking based on the switch signal after the first predetermined period; and f) returning to step b) when the quantity of heating water is lacking, and operating the circulation pump with a second operation manner for a third predetermined period when the quantity of heating water is not lacking, such that small bubbles which remain in the pipeline circuit after step b) are combined with one another to form large bubbles to be exhausted by the air exhausting means.

16. A method as recited in claim 15, wherein said first operation manner makes it repeat to drive the circulation pump for a third predetermined period and stop driving the circulation pump for a fourth predetermined period.

17. A method as recited in claim 16, wherein said third predetermined period is equal to the fourth predetermined period.

18. A method as recited in claim 17, wherein said third predetermined period is for ten-seconds.

19. A method as recited in claim 15, wherein said first predetermined period is for thirty-minutes.

20. A method as recited in claim 15, wherein said second operation manner makes it repeat to drive the circulation pump for a fifth predetermined period and stop driving the circulation pump for a sixth predetermined period.

* * * * *